US011596962B2

(12) United States Patent
Kang

(10) Patent No.: US 11,596,962 B2
(45) Date of Patent: Mar. 7, 2023

(54) MICRO PUMP VESSEL

(71) Applicant: Seong Il Kang, Seongnam-si (KR)

(72) Inventor: Seong Il Kang, Seongnam-si (KR)

( * ) Notice: Subject to any disclaimer, the term of this patent is extended or adjusted under 35 U.S.C. 154(b) by 551 days.

(21) Appl. No.: 16/489,940

(22) PCT Filed: Feb. 28, 2018

(86) PCT No.: PCT/KR2018/002451
§ 371 (c)(1),
(2) Date: Aug. 29, 2019

(87) PCT Pub. No.: WO2018/159996
PCT Pub. Date: Sep. 7, 2018

(65) Prior Publication Data

US 2020/0023393 A1 Jan. 23, 2020

(30) Foreign Application Priority Data

Mar. 3, 2017 (KR) ..... 10-2017-0027628

(51) Int. Cl.

| | |
|---|---|
| ***B05B 11/00*** | (2006.01) |
| ***A45D 40/22*** | (2006.01) |
| ***A45D 33/02*** | (2006.01) |
| ***A45D 40/00*** | (2006.01) |
| ***A45D 40/24*** | (2006.01) |

(52) U.S. Cl.
CPC ..... *B05B 11/3052* (2013.01); *A45D 33/025* (2013.01); *A45D 40/22* (2013.01); *A45D 40/24* (2013.01); *B05B 11/3073* (2013.01); *A45D 2040/0006* (2013.01); *A45D 2200/054* (2013.01); *A45D 2200/056* (2013.01)

(58) Field of Classification Search
CPC ..... A45D 40/0075; A45D 2200/054; A45D 2200/056; A45D 33/02; A45D 33/025; B05B 11/02; B05B 11/00416; B05B 11/00418; B65D 83/0005; B65D 83/0033
USPC ..... 132/286, 299, 293; 222/386, 398, 402
See application file for complete search history.

(56) References Cited

U.S. PATENT DOCUMENTS

| | | | | |
|---|---|---|---|---|
| 6,056,164 A * | 5/2000 | Wakayama | ..... | B65D 83/0005 222/386 |
| 6,375,045 B1 * | 4/2002 | Ki | ..... | B05B 11/00416 222/386 |
| 2016/0107182 A1 * | 4/2016 | Li | ..... | B05B 12/0026 222/309 |

(Continued)

FOREIGN PATENT DOCUMENTS

| | | | |
|---|---|---|---|
| KR | 200235847 Y1 * | 10/2001 | |
| KR | 20-0471797 Y1 | 3/2014 | |

(Continued)

*Primary Examiner* — Jacqueline T Johanas
*Assistant Examiner* — Sarah Woodhouse
(74) *Attorney, Agent, or Firm* — Heedong Chae; Lucem, PC

(57) ABSTRACT

A micro pump vessel has an outer vessel on one side of which a button is formed and an outer vessel lid which is hinge-coupled to one side of the outer vessel to be opened and closed. In the vessel, a first and a second pistons are installed on an upper surface of cosmetic contents, and thus, when the cosmetic contents are pumped and used by the operation of a micro pump, the first and the second pistons lower to exhaust all the cosmetic contents so as not to discard the remaining cosmetic contents.

4 Claims, 5 Drawing Sheets

(56) References Cited

U.S. PATENT DOCUMENTS

| | | | | |
|---|---|---|---|---|
| 2016/0157582 | A1* | 6/2016 | Jung | B05B 11/00416 222/383.1 |
| 2016/0242529 | A1* | 8/2016 | Oh | A45D 40/0075 |

FOREIGN PATENT DOCUMENTS

| | | | |
|---|---|---|---|
| KR | 10-2016-0005242 | A | 1/2016 |
| KR | 20-2016-0002144 | U | 6/2016 |
| KR | 10-2016-0083524 | A | 7/2016 |
| WO | 2015-122643 | A1 | 8/2015 |

* cited by examiner

MICRO PUMP VESSEL

TECHNICAL FIELD

The present invention relates to a micro pump vessel, and more particularly, to a micro pump vessel in which a pump for discharging cosmetics to the outside upon opening the outer vessel lid and pushing the discharge plate is formed of a smaller number of parts so that the manufacturing cost can be reduced.

BACKGROUND ART

In general, a compact container is configured such that a solid powder is accommodated in a container having a predetermined shape and is applied to a face using a powder puff of an application device which is accommodated therein when used.

However, when a solid powder is used as the compact, there are disadvantages that the solid powder is blown out during use and the feeling of adhesion is somewhat deteriorated when applied to the face.

Therefore, in order to overcome these disadvantages, a compact in a gel state in which a solid powder is mixed with a volatile substance has been developed, and it is a trend that the frequency of use is gradually increasing due to its convenience.

However, the compact in a gel state has a problem in that when exposed to the outside, the volatile substance is blown into the atmosphere and the powder is hardened stiffly or broken due to cracks.

As such, the inner space of the compact has to be hermetically sealed to the outside so that the volatile substance in a gel state is not to be blown out and hardened.

In addition, there is also a problem in that high manufacturing cost is incurred due to large number of parts constituting a pump installed inside.

Moreover, since there is no member to sweep down the cosmetic contents contained in the container, there is also a problem in that the cosmetic contents are not completely exhausted even if pumped, thereby discarding the remaining cosmetic contents.

DISCLOSURE

Technical Problem

The present invention has been proposed in order to meet the needs of the above-described prior arts, and it is an aspect of the present invention to provide a micro pump vessel in which a pump for discharging the cosmetic contents to the outside upon opening the outer vessel lid and pushing the discharge plate is formed of a smaller number of parts so that the manufacturing cost can be reduced and the cosmetic contents are completely exhausted.

Technical Solution

According to an aspect of the present invention, there is provided a micro pump vessel composed of an outer vessel 10 on one side of which a button 11 is formed and an outer vessel lid 20 which is hinge-coupled to one side of the outer vessel 10 to be opened and closed, including: an inner vessel 30 mounted inside the outer vessel 10; an inner vessel lid 40 which is coupled to an upper portion of the inner vessel 30 at a center of which a cosmetic suction hole 41 is formed; a micro pump 50, which is installed on an upper portion of the inner vessel lid 40 and pumps cosmetic contents; a circular plate-shaped discharge plate 60, which is inserted and seated on the top surface of the inner vessel lid 40 with the micro pump 50 therebetween, and which discharges and accommodates the cosmetic contents discharged from the micro pump 50 onto the top surface thereof; a circular plate-shaped member 70 which is seated in a central groove 61 of the top surface of the discharge plate 60 at an upper surface of which a radial groove 71 is formed; a discharge film 80, which is a circular plate-shaped film to cover the entire top surface of the discharge plate 60 and has a plurality of cosmetic discharge holes 81 so as to correspond to the radial groove 71 of the circular plate-shaped member 70; a ring-shaped fixing member 90 which fixes an edge of the discharge film 80 to the discharge plate 60, an upper portion of which is exposed to the outside to allow a user to make contact using a puff P; a first piston 100 of a cylindrical member which is inserted to a bottom surface of the inner vessel lid 40 and close contact with the inner circumference of the inner vessel lid 40 to sweep down the cosmetic contents in the outer vessel 10; and a second piston 110 which is inserted to a lower portion of the first piston 100 to sweep down the cosmetic contents in the outer vessel 10 and exhaust them.

Advantageous Effects

According to the micro pump vessel of the present invention, the present invention is configured that the lower portion of the inner vessel lid, that is, the first and the second pistons are installed on the upper surface of the cosmetic contents, and thus, when the cosmetic contents are pumped and used by the operation of the micro pump, the first and the second pistons lower to exhaust all the cosmetic contents so as not to discard the remaining cosmetic contents.

BEST MODE

Figure 1:
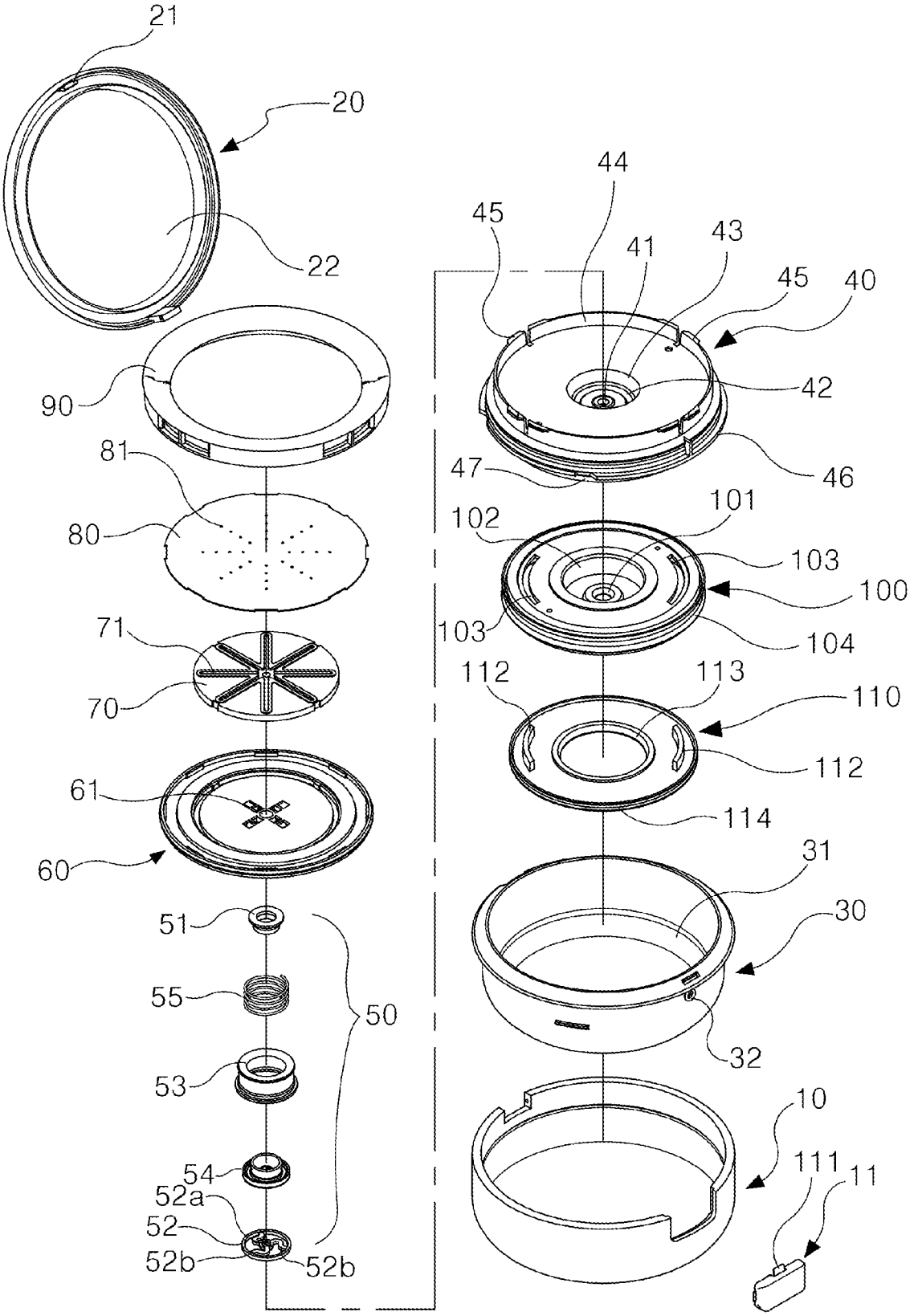
FIG. 1 is an exploded perspective view showing a micro pump vessel of the present invention.

Hereinafter, preferred embodiments of the present invention will be described with reference to the accompanying drawings so that those skilled in the art can easily carry out the present invention. It should be noted that the reference numbers to denote the elements in the attached drawings are used by the same ones even in other drawings for the same elements, if possible.

In the description of the present invention, a detailed description on known functions or known configurations incorporated herein will be omitted when it may make the subject matter of the present invention unclear. And, some elements shown in the drawings are exaggerated, reduced, or simplified for ease of explanation, and the drawings and their components are not necessarily drawn in proper portion. However, those skilled in the art will easily understand these particular matters.

Although the terms including ordinal numbers such as first, second, etc. may be used herein to describe various elements, these elements are not limited by these terms. These terms are used only to distinguish one component from another element. For example, a first component may be referred to as a second component without departing from the scope of claims of the present invention, and similarly, the second component may also be referred to as the first component. As used herein, the term "and/or" includes any and all combinations of one or more of the associated listed items.

In addition, relative terms such as 'front surface', 'rear surface', 'top surface', 'lower surface' described on the basis of what is shown in the drawings may be replaced by ordinal numbers such as 'first', 'second', etc.

The ordinal numbers such as 'first'. 'second', and the like are defined in the order as described or set arbitrarily, and thus the order may be arbitrarily changed as necessary. The terminology used herein describes only particular embodiments, and the present invention is not limited thereby. As used herein, the singular terms are intended to include the plural forms as well, unless the context clearly indicates otherwise. It will be further understood that the terms "including" or "having", when used in this specification, specify the presence of stated features, integers, steps, operations, components, parts, or combinations thereof but do not preclude the presence or addition of one or more other features, integers, steps, operations, components, parts, or combinations thereof.

Unless defined otherwise, all terms used herein, including technical or scientific terms, have the same meaning as commonly understood by those skilled in the art to which this invention belongs. Terms such as those defined in commonly used dictionaries are to be interpreted as having a meaning consistent with the contextual meaning of the related art but are not to be interpreted as either ideal or overly formal meaning unless clearly defined in the present application.

Hereinafter, preferred embodiments of the present invention will be described in detail with reference to the accompanying drawings. In the description of the present invention, a detailed description on known functions or known configurations incorporated herein will be omitted when it may make the subject matter of the present invention unclear.

EMBODIMENT

Figure 2:
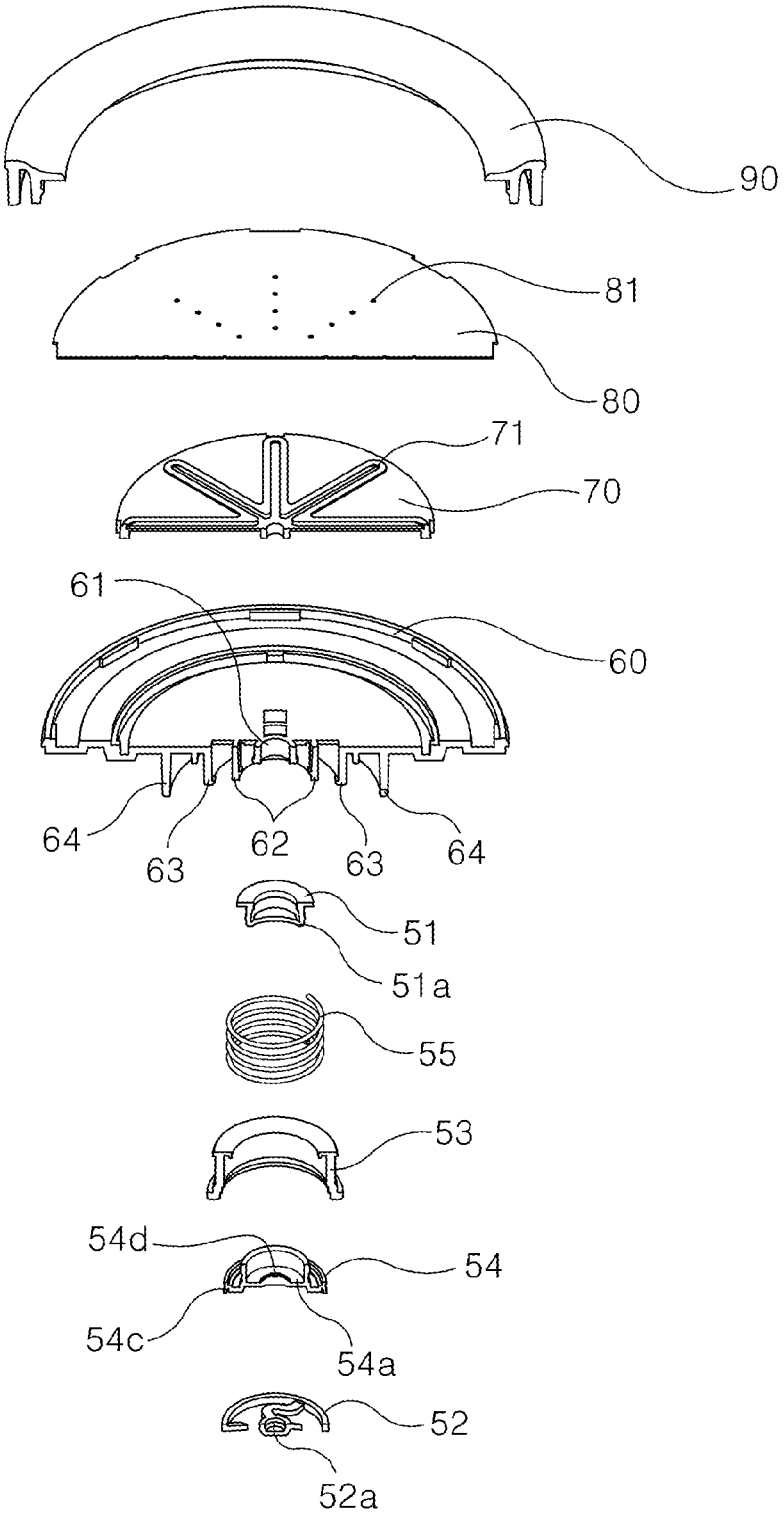
FIG. 2 is an exploded perspective view showing the micro pump vessel of the present invention.
Figure 3:
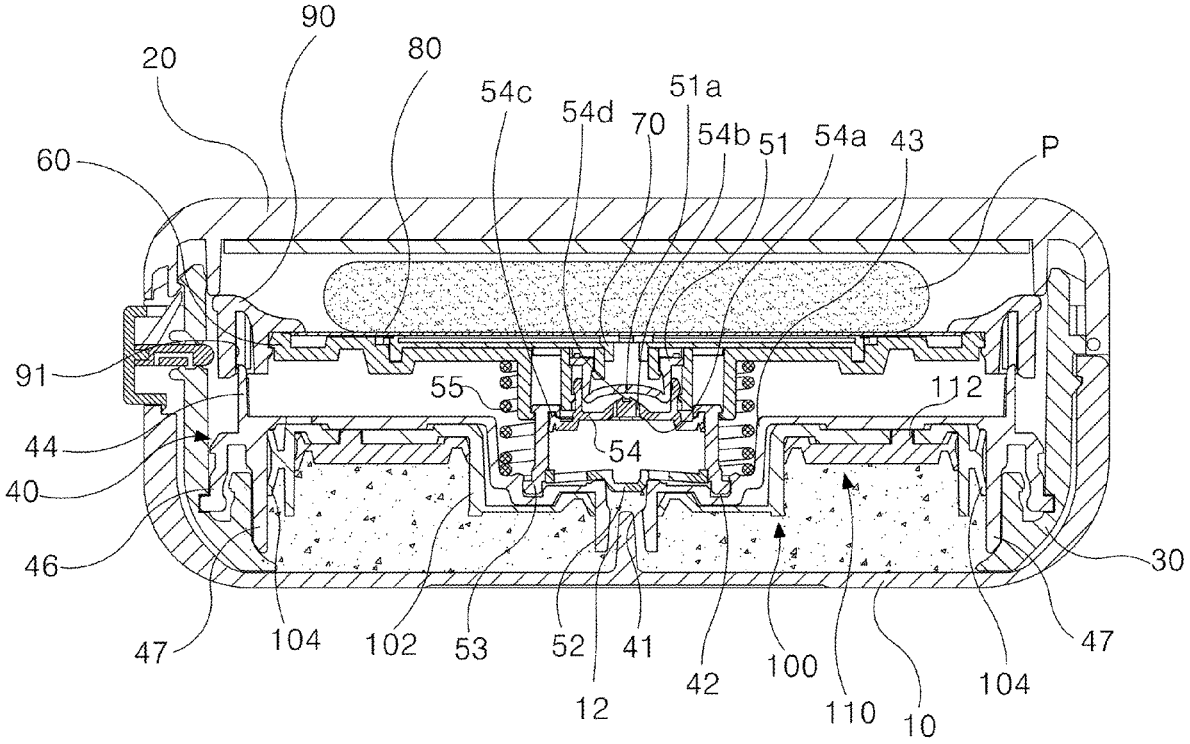
FIG. 3 is an assembled cross-sectional view showing the vessel of the present invention.
Figure 4:
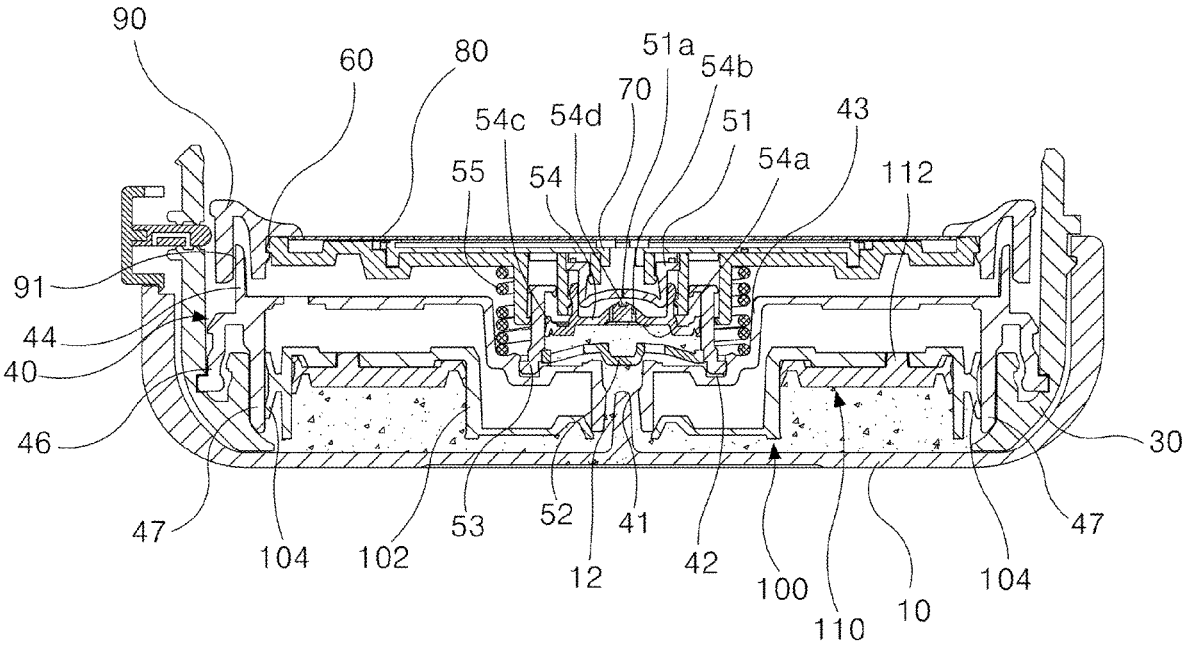
FIG. 4 is a cross-sectional view showing the state when the first piston of the micro pump vessel is operated.
Figure 5:
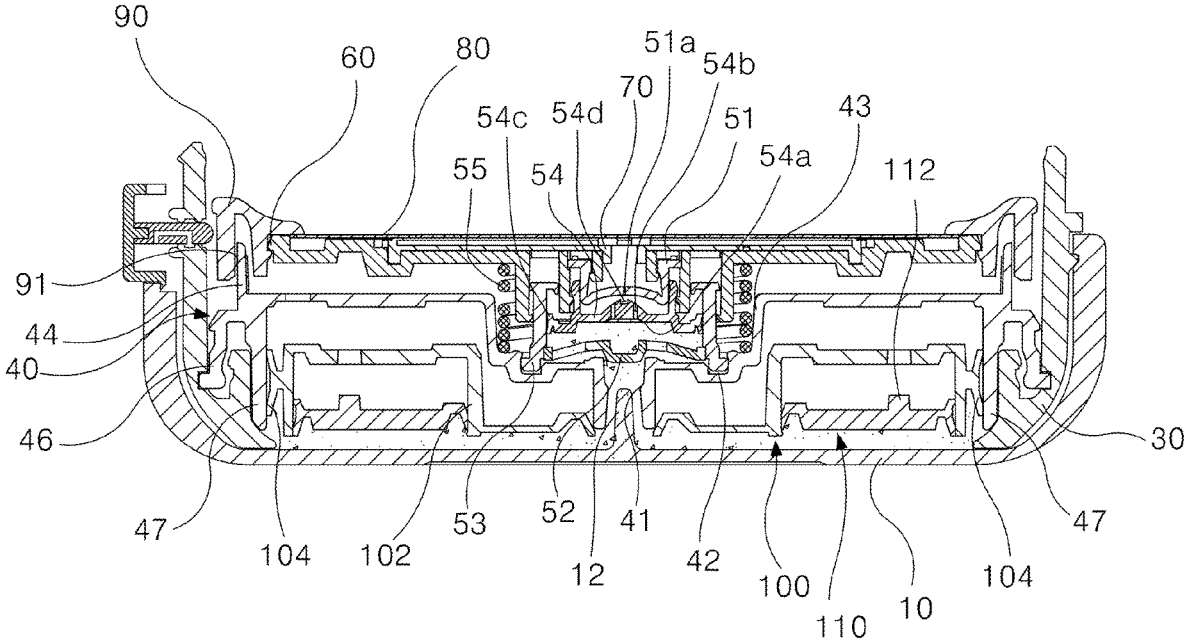
FIG. 5 is a cross-sectional view showing the state when the second piston of the micro pump vessel is operated.

FIG. 1 is an exploded perspective view showing a micro pump vessel of the present invention, FIG. 2 is an exploded perspective view showing the micro pump vessel of the present invention, FIG. 3 is an assembled cross-sectional view showing the micro pump vessel of the present invention, FIG. 4 is a cross-sectional view showing the state when a first piston of the micro pump vessel is operated, and FIG. 5 is a cross-sectional view showing the state when a second piston of the micro pump vessel is operated.

The micro pump vessel according to the present invention, as shown in FIGS. 1 to 5, is composed of an outer vessel 10 on one side of which a button 11 is formed and an outer vessel lid 20 which is hinge-coupled to one side of the outer vessel 10 to be opened and closed, wherein the vessel includes: an inner vessel 30 mounted inside the outer vessel 10; an inner vessel lid 40 which is coupled to an upper portion of the inner vessel 30 at a center of which a cosmetic suction hole 41 is formed; a micro pump 50 which is installed on an upper portion of the inner vessel lid 40 and pumps cosmetic contents; a circular plate-shaped discharge plate 60 which is inserted and seated on the top surface of the inner vessel lid 40 with the micro pump 50 therebetween, and which discharges and accommodates the cosmetic contents discharged from the micro pump 50 onto the top surface thereof; a circular plate-shaped member 70 which is seated in a central groove 61 of the top surface of the discharge plate 60 at an upper surface of which a radial groove 71 is formed; a discharge film 80 which is a circular plate-shaped film to cover the entire top surface of the discharge plate 60 and has a plurality of cosmetic discharge holes 81 so as to correspond to the radial groove 71 of the circular plate-shaped member 70; a ring-shaped fixing member 90 which fixes an edge of the discharge film 80 to the discharge plate 60, an upper portion of which is exposed to the outside to allow a user to make contact using a puff P; a first piston 100 of a cylindrical member which is inserted to a bottom surface of the inner vessel lid 40 and in close contact with the inner circumference of the inner vessel lid 40 to sweep down the cosmetic contents in the outer vessel 10; and a second piston 110 which is inserted to a lower portion of the first piston 100 to sweep down the cosmetic contents in the outer vessel 10 and exhaust them.

A button 11 is formed on one side of the outer vessel 10, integrally with a slant projection 111 slantly formed on the upper side of the button 11 so that the outer vessel lid 20 is opened by pushing a hook 21 formed on one side thereof by the user's pressing action.

The outer vessel lid 20 serves to open and close the outer vessel 10 on one side of which the protrusion-shaped hook 21 corresponding to the slant projection 111 of the button 11 is formed.

In addition, a mirror 22 is provided inside the outer vessel lid 20 so that the user can easily make cosmetics.

First to third circumferential grooves 62, 63, 64 are spaced apart at a predetermined interval and are formed sequentially from one having the smallest inner diameter so that the micro pump 50 is mounted on the lower surface of the circular plate-shaped discharge plate 60.

The micro pump vessel 50 includes: a cylindrical rubber sealing cap 51 which is a member inserted into the first circumferential groove 62 of the discharge plate 60, an upper portion of which is opened and a lower portion thereof is closed, and at a center thereof, a sheath 51*a* is formed; a housing cap 53 of a cylindrical member, an upper opening of which is inserted between the first circumferential groove 62 and the second circumferential groove 63 of the discharge plate 60, and a check valve 52 is inserted into a lower inner circumference thereof; and a piston-type member 54 of a cylindrical member, an upper opening of which is fitted between a lower outer circumference of the rubber sealing cap 51 and an inner circumference of the first circumferential groove 62 of the discharge plate 60, wherein a plurality of holes 54*b* are formed around a center portion of a lower surface 54*a*, a close contact surface 54*c* is formed so as to extend toward the outside of the lower surface 54*a* to be in close contact with the inner circumference of the housing cap 53, and a projection groove 54*d* is formed in the forward and backward directions on a protruding portion protruding at the center of the lower surface 54*a*, and a cylindrical spring 55 is provided between the lower surface of the discharge plate 60 and the upper surface of the inner vessel lid 40.

A sheath 51*a* is positioned at a center of the projection groove 54*d* so that the cosmetic contents are discharged through the sheath 51*a* opened when the projection groove 54*d* is in contact with the rubber sealing cap 51.

The check valve 52 is provided with: a central closing portion 52*a* formed at a center so as to be pushed up by a rod 12 protruding from the bottom center of the outer vessel 10; and a plurality of S-shaped connecting members 52*b* for flexibly connecting the outer circumference of the central closing portion 52*a* and the inner circumference of the check valve 52.

A first mounting groove 42 is formed in a cylindrical shape outside the cosmetic suction hole 41 of the inner vessel lid 40, into which the lower end of the housing cap 53 of the micro pump 50 is inserted, and a second mounting groove 43 formed with a larger diameter than the first pump mounting groove 42 so that a cylindrical spring 55 of the micro pump 50 is inserted and seated.

An upper extension protrusion wheel 44 is formed extending upward on an outer circumference of the inner vessel lid 40, and a fastening protrusion 45 is formed at an upper side of the upper extension protrusion wheel 44 to be coupled to a lower guide groove 91 of the ring-shaped fixing member 90.

A coupling portion 46 is formed on the outer circumferential lower side of the inner vessel lid 40 to be coupled to the inner vessel 30, and a lower extension protrusion wheel 47 protruding downward is formed inside the coupling portion 46.

The first piston 100 includes: a central hole 101 formed in the center of the first piston and inserted into the outer circumference of the suction hole 41 of the inner vessel lid 40; a cylindrical groove 102 formed with a larger diameter than the central hole 101 and surrounding the outer circumference and the bottom surface of the second mounding groove 43 of the inner vessel lid 40; a cylindrical hole 103 into which a columnar projection 112 protruding from the upper surface of the second piston 110 is inserted and coupled to the upper surface of the first piston; and a close contact plate 104 protruding downward from the outer circumference of the first piston and in close contact with the inner circumference of the lower extension protrusion wheel 47 of the inner vessel lid 40.

The second piston 110 is a circular ring plate-shaped member, which includes a central close contact hole 113 in close contact with the outer circumference of the cylindrical groove 102 of the first piston 100, and an outer circumferential close contact plate 114 formed on the circumference of the second piston and in close contact with the inner circumference of a close contact plate 104.

The assembly method of the micro pump container of the present invention configured as described above is as follows.

In order to assemble the micro pump vessel of the present invention, the inner vessel 30 is first fitted to be coupled into the outer vessel 10, and then injected cosmetic contents into the inner vessel 30.

Next, the inner vessel lid 40 is installed to be fixed to the upper portion of the inner vessel 30 to seal the inner vessel 30.

The first and the second pistons 100, 110 are inserted to be installed on the lower portion of the inner vessel lid 40.

Thereafter, the micro pump 50 is installed between the inner vessel lid 40 and the discharge plate 60. In detail, a rubber sealing cap 51 on the lower surface of which a sheath 51*a* is formed is inserted into the first circumferential groove 62 of the discharge plate 60, the upper opening of the piston-type member 54 is inserted into the lower outer circumference of the rubber sealing cap 51, and a lower end close contact surface 54*c* is inserted and coupled to be in close contact with the inner circumference of the housing cap 53 which is inserted between the first circumferential groove 62 and the second circumferential groove 63.

In order to use the micro pump vessel, first, when the button 11 on the side surface of the vessel is pressed, the hook 21 of the outer vessel lid 20 is pushed up to open the outer vessel lid 20.

In this way, while the outer vessel lid 20 is opened, the discharge plate 60 is pressed by using the puff P.

When the discharge plate 60 is pressed, the cylindrical spring 55 is compressed to lower the housing cap 53, the rod 12 protruding from the center of the bottom of the outer vessel 10 pushes up the central closing portion 52*a*, cosmetic contents are introduced into the housing cap 53 through spaces among a plurality of S-shaped connecting members 52*b*, these introduced cosmetic contents are discharged through a plurality of holes 54*b* of the piston-type member 54, the rubber sealing cap 51 is in contact with the projection groove 54*d* of the piston-type member 54 by lowering of the discharge plate 60 so that the sheath 51*a* is opened, and thereby cosmetic contents are discharged onto the top surface of the discharge plate 60.

As the cosmetic contents in the outer vessel 10 are discharged through the micro pump 50, the volume thereof is reduced so that the first piston 100 at the lower end of the inner vessel lid 40 is lowered together with the second piston 110 (FIG. 4), and when the cosmetic contents are continuously discharged, the second piston 110 is also lowered to exhaust the cosmetic contents. That is, the cosmetic contents are not completely exhausted when there is no first piston 100 and the second piston 110. However, since the first and the second pistons 100, 110 are built in, the inside of the outer vessel 10 is vacuumed, and as the volume becomes smaller, the first and the second pistons 100, 110 are lowered to completely exhaust the cosmetic contents.

As described above, although the present invention has been described in relation to a detailed embodiment of the present invention, it is apparent that those skilled in the art to which the present invention pertains can easily implement by modifying the described embodiments, and these modified embodiments would be included within the technical spirit of the claims of the present invention.

The invention claimed is:

1. A micro pump vessel composed of an outer vessel (10) on one side of which a button (11) is formed and an outer vessel lid (20) which is hinge-coupled to one side of the outer vessel (10) to be opened and closed, comprising:

an inner vessel (30) provided inside the outer vessel (10);

an inner vessel lid (40) coupled to the inner vessel (30) at a center of which a cosmetic suction hole (41) is formed;

a micro pump (50) installed on an upper portion of the inner vessel lid (40) to pump cosmetic contents;

a circular plate-shaped discharge plate (60), which is inserted and seated on the top surface of the inner vessel lid (40) with the micro pump (50) therebetween to discharge and accommodate the cosmetic contents discharged from the micro pump (50) onto the top surface thereof;

a circular plate-shaped member (70) seated in a central groove (61) of the top surface of the discharge plate (60) and having, at an upper surface, a radial groove (71);

a discharge film (80), which is a circular plate-shaped film to cover the entire top surface of the discharge plate (60) and has a plurality of cosmetic discharge holes (81) so as to correspond to the radial groove (71) of the circular plate-shaped member (70);

a ring-shaped fixing member (90) configured to fix an edge of the discharge film (80) to the discharge plate (60) and allow a user to make contact with the discharge film (80) using a puff (P);

a first piston (100) of a cylindrical member which is inserted to a lower surface of the inner vessel lid (40) and coupled to be in close contact with the inner circumference of the inner vessel lid to sweep down the cosmetic contents in the outer vessel (10), the first piston (100) having a cylindrical hole (103) and a close contact plate (104) protruding downward from an outer circumference of the first piston (100), wherein the first piston (100) is in contact with the cosmetic contents; and a second piston (110) having a columnar projection (112) that is constructed to be inserted into the cylindrical hole (103) of the first piston, the second piston (110) configured to be inserted to a lower portion of the first piston (100) to sweep down the cosmetic contents in the outer vessel (10) and exhaust them, wherein the second piston (110) is in contact with the cosmetic contents, wherein the cylindrical hole (103) is formed on an upper surface of the first piston (100) and the columnar projection (112) is formed on an upper surface of the second piston (110), wherein the columnar projection (112) is constructed to be inserted into the cylindrical hole (103), wherein when a volume of the cosmetic contents is reduced, the first piston (100) is lowered together with second piston (110), and wherein when the cosmetic contents are continuously discharged, the second piston (110) is lowered separately from the first piston (100) to exhaust the cosmetic contents.

2. The micro pump vessel according to claim 1, wherein the inner vessel lid (40) comprises:

a first mounting groove (42) formed in a circumferential shape so that the lower end of a housing cap (53) of the micro pump (50) is inserted to the outer side of the cosmetic suction hole (41) of the inner vessel lid (40);

a second mounting groove (43) formed with a larger diameter than the first pump mounting groove (42) so that a cylindrical spring (55) of the micro pump (50) is inserted and seated;

an upper extension protrusion wheel (44) formed extending upward on an outer circumference of the inner vessel lid (40);

a fastening protrusion (45) formed to be coupled to a lower guide groove (91) of the ring-shaped fixing member (90) at an upper side of the upper extension protrusion wheel (44);

a coupling portion (46) formed on the outer circumferential lower side of the inner vessel lid (40) to be coupled to the inner vessel (30); and a lower extension protrusion wheel (47) protruding downward inside the coupling portion (46).

3. The micro pump vessel according to claim 2, wherein the first piston (100) comprises:

a central hole (101) formed in the center of the first piston and disposed about the outer circumference of the suction hole (41) of the inner vessel lid (40);

a cylindrical groove (102) formed with a larger diameter than the central hole (101) and surrounding the outer circumference and the bottom surface of the second mounting groove (43) of the inner vessel lid (40).

4. The micro pump vessel according to claim 2, wherein the second piston (110), which has a ring shape, comprises: a central close contact hole (113) in close contact with the outer circumference of a cylindrical groove (102) of the first piston (100) at the center of the first piston; and an outer circumferential close contact plate (114) formed on the outer circumference of the second piston (110) and in close contact with the inner circumference of the close contact plate (104) of the first piston (100).

* * * * *